US005503142A

United States Patent [19]

Semeia

[11] Patent Number: 5,503,142

[45] Date of Patent: Apr. 2, 1996

[54] REGULATOR FOR UNDERWATER BREATHING APPARATUSES

[75] Inventor: Roberto Semeia, San Salvatore di Cogorno, Italy

[73] Assignee: Scubapro Europe S.r.l., Genoa, Italy

[21] Appl. No.: 454,947

[22] Filed: May 31, 1995

[30] Foreign Application Priority Data

Nov. 24, 1994 [IT] Italy ..... MI94A2391

[51] Int. Cl.[6] ..... A62B 18/10

[52] U.S. Cl. ..... 128/201.28; 128/204.26; 128/205.24

[58] Field of Search ..... 128/201.28, 204.26, 128/205.24; 251/100

[56] References Cited

U.S. PATENT DOCUMENTS

| | | | |
|---|---|---|---|
| 807,243 | 12/1905 | Chapin | 251/100 |
| 1,182,375 | 5/1916 | Hutson | 251/100 |
| 1,387,991 | 8/1921 | Kunke et al. | 251/100 |
| 5,233,976 | 8/1993 | Ferguson | 128/204.26 |
| 5,259,375 | 11/1993 | Schuler | 128/204.26 |
| 5,265,596 | 11/1993 | Sauze | 128/204.26 |
| 5,437,268 | 8/1995 | Preece | 128/201.28 |

*Primary Examiner*—Aaron J. Lewis
*Attorney, Agent, or Firm*—Rosen, Dainow & Jacobs

[57] ABSTRACT

A regulator (2) for an under water breathing apparatus (1) comprises a body (7), a duct (5) for delivery of breathable mixture, a shutter (20) of soft material stressed towards a shutter seat (5*a*), a push button (11) acting via a lever (21) on the shutter (20) to control it to move away from the shutter seat (5*a*) upon manual delivery of the breathable mixture, removable locking means (24)in the said push button (11) for locking the lever (21) in a position in which the said lever (21) retains the shutter (20) in a position just touching the shutter seat (5*a*) to prevent damage to the shutter (20) in inactive periods of the regulator (2).

9 Claims, 4 Drawing Sheets

REGULATOR FOR UNDERWATER BREATHING APPARATUSES

BACKGROUND OF THE INVENTION

1. Field of the Invention

The present invention relates to a regulator for an underwater breathing apparatus of the type comprising a body, a duct in the said body for delivery of breathable mixture, a shutter seat in the said duct, a shutter of soft material stressed by an adjustable spring towards the said shutter seat, and a push button acting via a lever on the shutter to control it to move away from the shutter seat upon manual delivery of breathable mixture.

2. Description of the Prior Art

In regulators of the type considered it has been found that during long periods of inactivity of the regulator, for example during the winter season, the soft shutter is incised by its shutter seat because of the large force with which it is compressed by the adjustable spring.

The incision of the shutter, whilst not per se prejudicial to the seal of the shutter itself, causes an extension of the adjustable spring which loses part of the original load. In this way, upon reestablishment of normal operating conditions, the spring is no longer as able to combat the pressure of the breathable mixture giving rise to losses.

It has been suggested that the shutter be spaced from its seat during the said periods of inactivity by a complete compression of the adjustable spring.

Over a long period however such compression causes weakening of the spring necessitating its replacement.

SUMMARY OF THE INVENTION

The technical problem on which the present invention is based is that of devising an underwater breathing apparatus regulator which will have structural and functional characteristics such as to overcome the said disadvantage.

This problem is solved by a regulator of the type specified which is characterised in that it includes, in the said push button, removable locking means for locking the lever in a position in which the said lever retains the shutter just touching the shutter seat.

The principal advantage of the regulator of the invention arises due to the fact that damage to the shutter of the regulator during periods of inactivity is prevented.

Further characteristics and advantages of the regulator according to the present invention will become apparent from the description of a preferred embodiment given hereinafter by way of non-limitative indication with reference to the attached drawings.

DESCRIPTION OF THE PREFERRED EMBODIMENT

Figure 1:
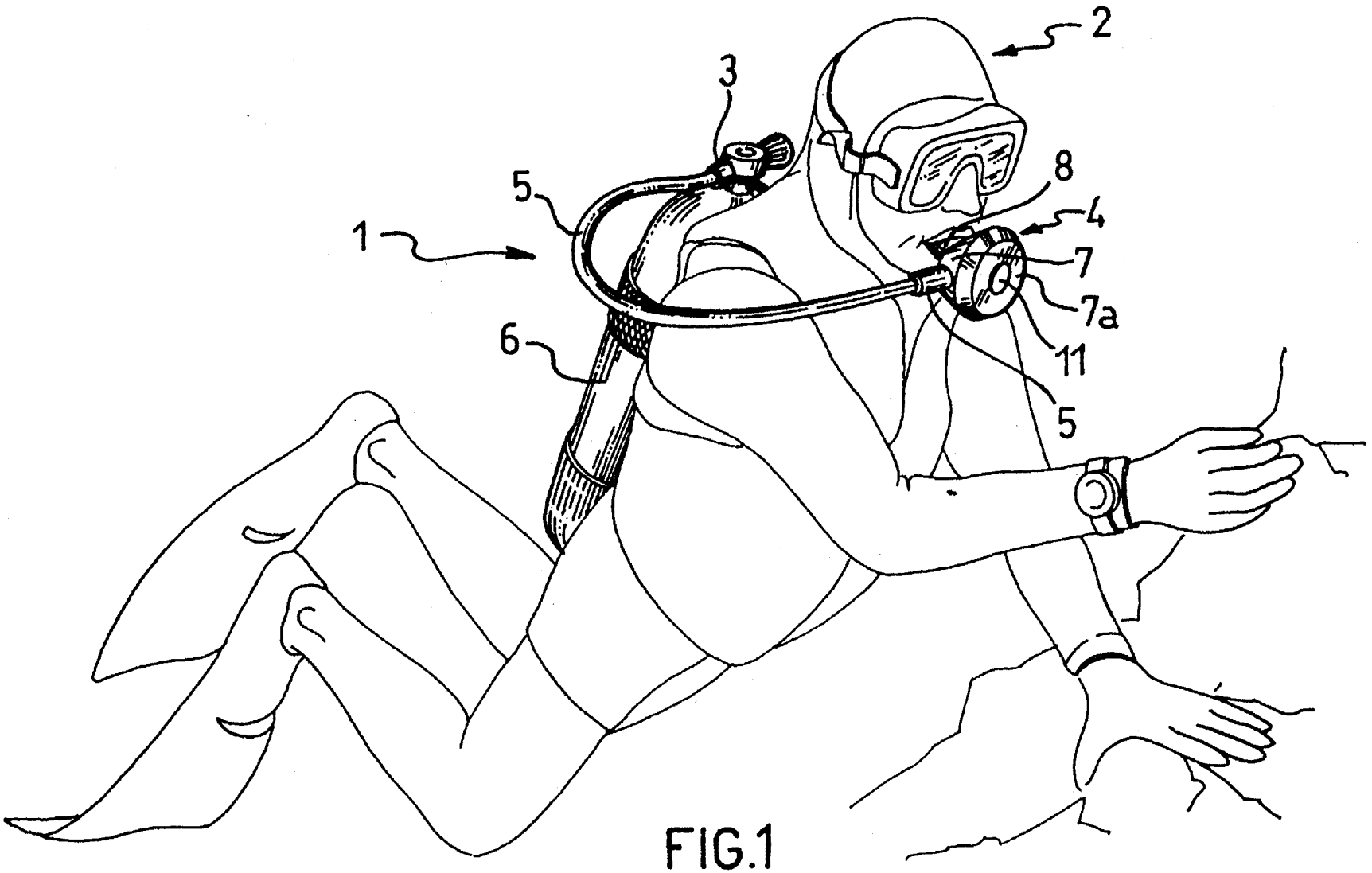
FIG. 1 shows an underwater breathing apparatus which incorporates a regulator according to the invention, worn by a diver.
Figure 2:
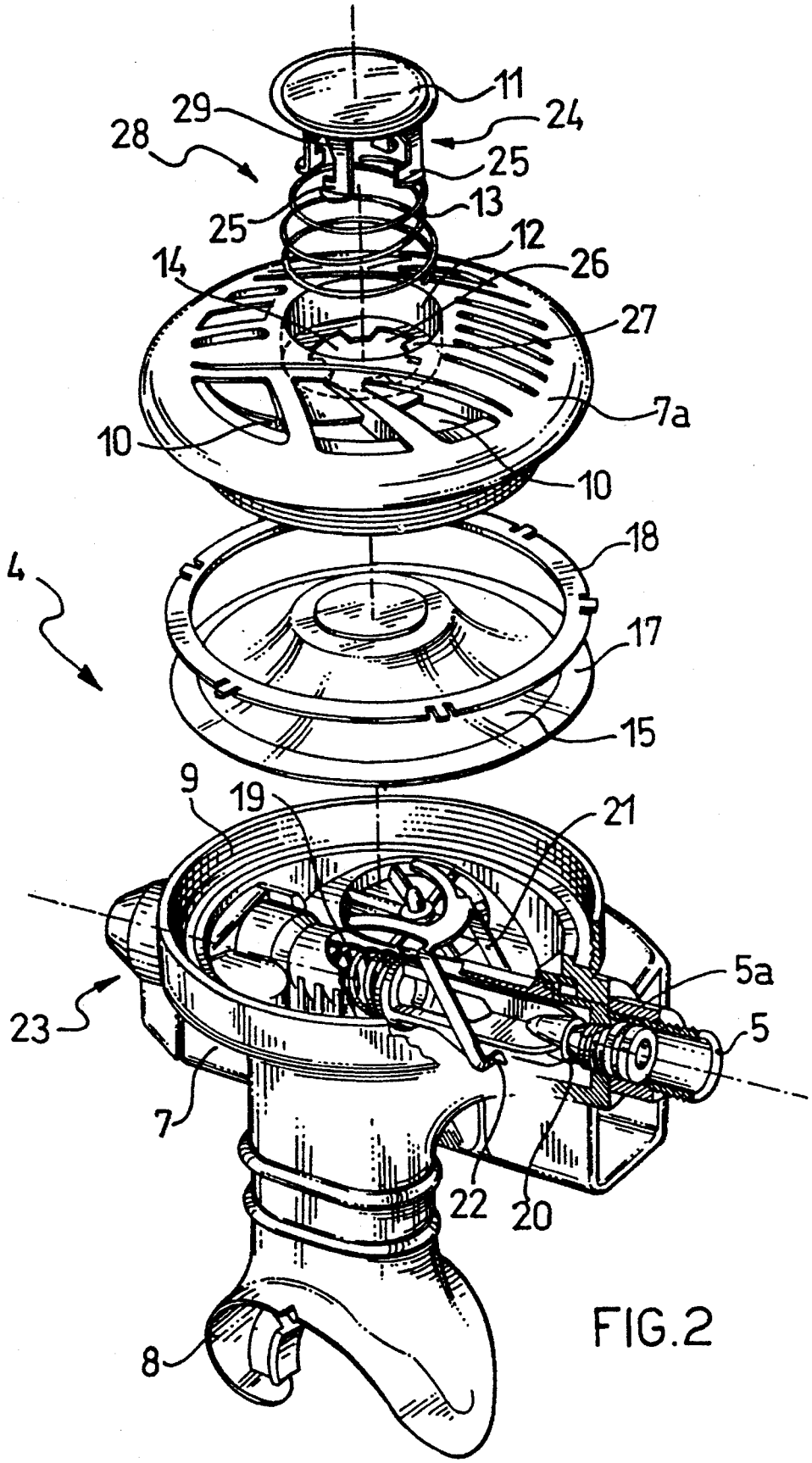
FIG. 2 is an exploded, partially sectioned, perspective view of a detail of the regulator of FIG. 1.
Figure 3:
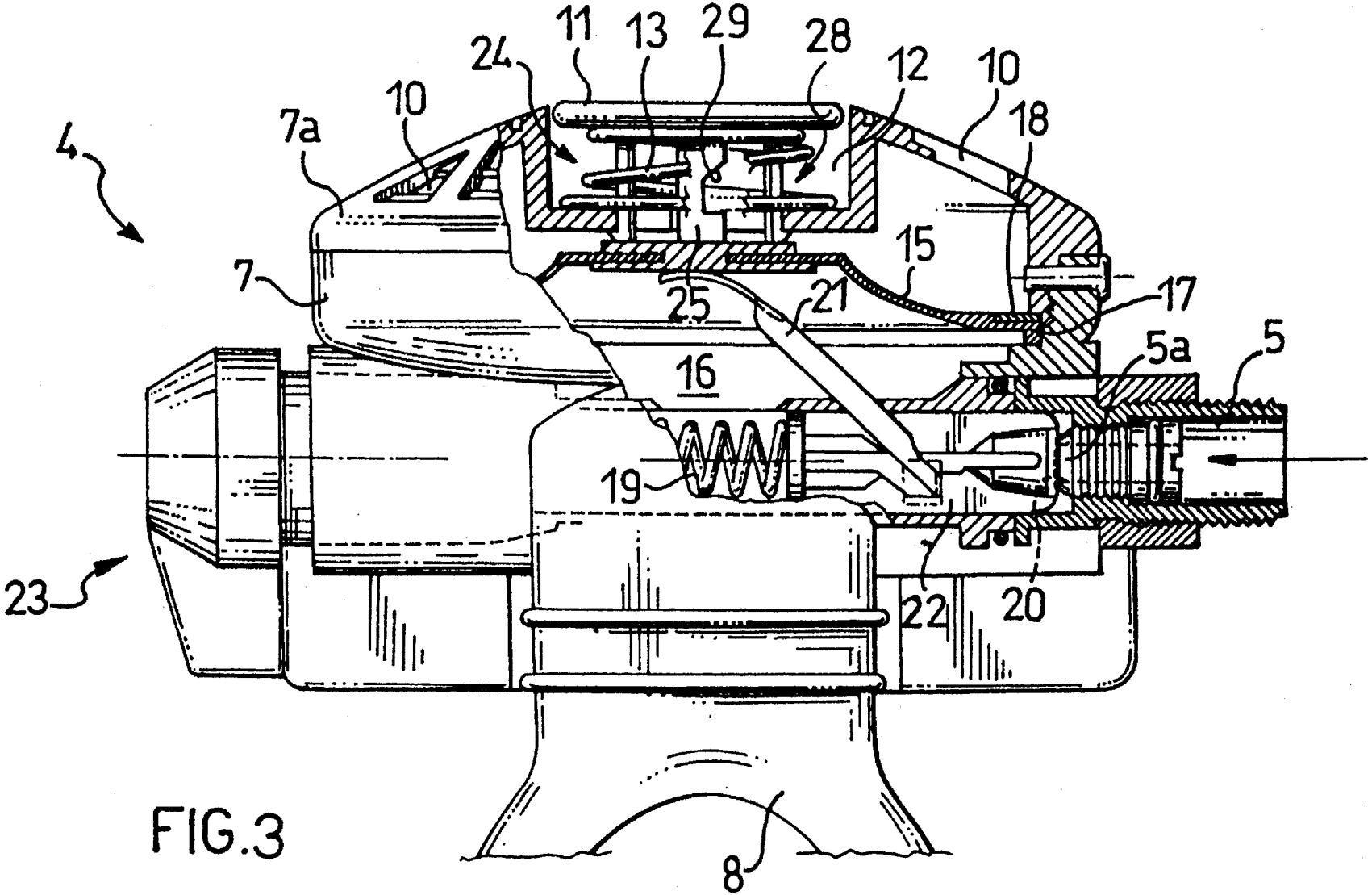
FIG. 3 is a partially sectioned transverse view of the detail of FIG. 2, arranged for use.
Figures 4, 5:
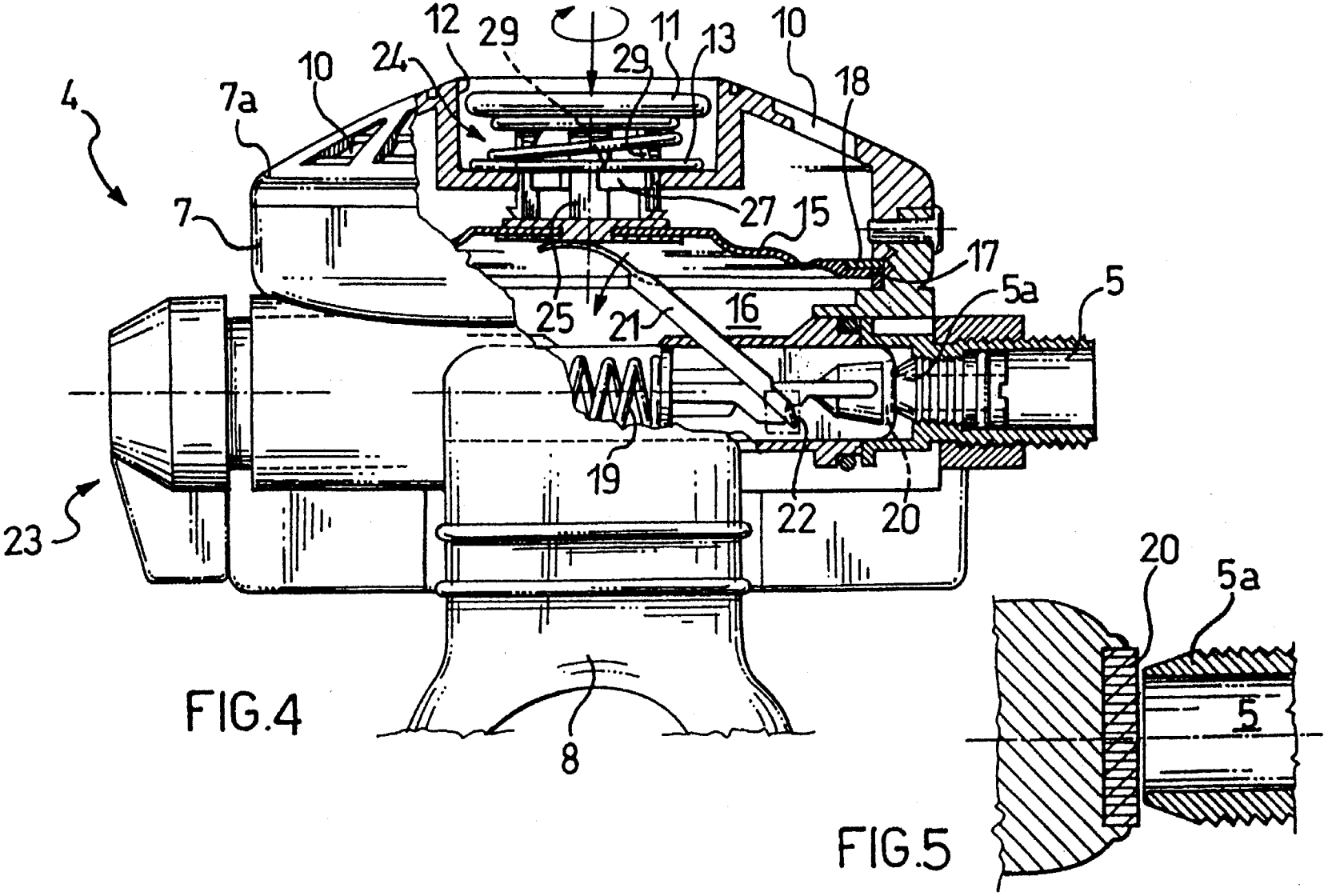
FIG. 4 is the partially sectioned transverse view of the detail of FIG. 2 shown arranged for a period of inactivity.
FIG. 5 is an enlarged perspective view of the detail of FIG. 4.

In the drawings an underwater breathing apparatus of the type delivering a breathable mixture, for example air, is generally indicated 1 and shown worn by a diver.

The breathing apparatus 1 has a regulator 2 which comprises a first stage 3, a second stage 4, a duct 5 which connects the first stage 3 and the second stage 4, and a pressure bottle 6 on which the first stage 3 is directly positioned.

The first stage 3 has the function of providing the second stage 4 through the duct 5 with air at a pressure intermediate between the storage pressure in the bottle 6 and the breathing pressure.

The regulator 2 comprises a body 7 which defines the said second stage 4, into which the said duct 5 opens for the delivery of air, and a mouthpiece 8 connected to the body 7.

The body 7 includes a cap **7*a* of circular form threadedly engaged over and closing the aperture 9 of the body, substantially symmetrical to the mouthpiece 8 for access to its interior. This cap 7*a* has a plurality of slots 10**.

The regulator 2 further includes a push button 11 fitted in a push button seat 12, this latter being formed integrally in the said cap **7*a* and being of cylindrical form to allow free rotation of the push button 11** within it.

Within a push button seat 12 is disposed a biasing spring 13 which surrounds the push button 11 and which maintains it in a raised position. The push button seat 12 further has a hole 14 through which the push button 11 extends into the body 7 when it is pressed against the action of the biasing spring 13.

Over the body 7 is disposed a membrane 15 of frustoconical form extending over the aperture 9, which defines a chamber 16 for the flow of the said breathable mixture within the body 7, across which it faces the said mouthpiece 8.

The membrane 15 has an edge 17 mechanically engaged on the said body 7 under the threaded engagement of the cap **7*a* with the interposition of a sealing ring 18**.

Through the hole 14 the push button 11 can act directly on the membrane 15 pressing it towards the interior of the chamber 16.

Within the chamber 16 the regulator 2 includes a shutter seat **5*a*, in the said duct 5, and a shutter 20 of soft material stressed by an adjustable spring 19 towards the shutter seat 5*a***.

The push button 11 is able to act on the valve shutter 20, via a lever 21 and through the membrane 15, to control it to move away from the shutter seat **5*a*** for manual delivery of air.

The said lever 21 is located within the chamber 16 and extends between the membrane 15 and a pivot 22. The shutter 20 is connected to the lever 21 in an intermediate position between the membrane 15 and the pivot 22.

Adjustment means 23 are provided for adjustment of the spring 19 connected to the body 7.

The regulator 2 according to the invention includes removable locking means 24 in the push button 11 for locking the lever 21 in a position in which the lever 21 retains the shutter 20 just touching the shutter seat **5*a***.

The said removable locking means 24 comprise a plurality of hooks 25 integrally formed in the push button 11, each lying in a plane tangential to the cylinder defined by the push button 11.

The said removable locking means 24 further include a corresponding plurality of recesses 26 formed laterally of the hole 14 in the said push button seat 12, each of which has an engagement edge 27.

The hooks 25, the recesses 26 and the engagement edges 27 are shaped in such a way as substantially to form a bayonet coupling for the push button 11 in the said push button seat 12.

For this purpose the hooks 25 are disposed to move axially through the said recesses 26 and, following rotation of the push button 11 in its seat 12, the said engagement edges 27 are intended to interfere with the said hooks 25.

In the translation movement of the push button 11 the hooks 25 are intended to enter the interior of the body 7 through the said recesses 26 to contact the membrane 15 and, through this latter, press the lever 21 for manual delivery of breathable mixture.

The regulator 2 according to the invention further includes rapid resetting means 28 for resetting the lever 21 in such a way that the regulator 2 can be rapidly connected to the air bottle 6 under pressure without unwanted losses, by the push button 11.

Such rapid resetting means 28, according to a preferred version of the present invention, comprise the said return spring 13 and a plurality of inclined shoulders 29 formed integrally with the push button 11 and positioned above the said hooks 25.

The said inclined shoulders 29 are disposed in such a way as to interfere with the corresponding engagement edges 27 when the push button 11 is pushed in fully starting from the position in which the said lever 21 retains the shutter 20 in the position where it is just touching the shutter seat 5*a* as will be apparent more clearly from the description of the operation of the regulator 2 according to the invention.

When the regulator 2 is in operation, connected to the air bottle 6 containing air under pressure, the depression which is instigated in the chamber 16 during the act of respiration causes deflection of the membrane 15 which presses the lever 21.

The rotation of the lever 21 causes the shutter 20 to open against the action of the adjustable spring 19 and in accordance with the pressure acting on the shutter 20.

Opening of the shutter 20 causes air to flow into the chamber 15 where it re-establishes the starting pressure with consequent closure of the shutter 20.

When a requirement for manual delivery of compressed air arises, for example in emergency situations or to inflate an underwater balloon, it is sufficient to press the push button 11 fully to open the shutter 20 through the membrane 15 and the lever 21.

The action of the push button 11 acts directly against the spring 19 via the lever 21.

When the regulator 2 is disconnected from a pressurised air bottle the adjustable spring 19, calibrated to oppose the pressure of the air in the air bottle 6, presses the shutter 20 forcibly against the shutter seat 5*a*.

In this situation the user operates on the removable locking means 24 of the lever 21 by partially pressing the push button 11 and rotating it with the simple friction of the finger tip thus engaging the hooks 25 in the recesses 26 beneath the engagement edges 27.

The action of the push button 11 and the subsequent engagement of the hooks 25 causes locking of the lever 21 at its partial compression which, against the action of the spring 19 holds the shutter 20 spaced from the shutter seat 5*a* just enough to cause the said touching.

To release the lever 21 and obtain a rapid resetting of the regulator 2 according to the invention it is sufficient to press the push button 11 completely. In this way the inclined shoulders 29 interfere with the engagement edges 27 thereby causing a rotation of the push button 11 in its seat 12 in a direction opposite that necessary to engage the hooks 25.

At the bottom of the stroke the hooks 25 are free within the interior of the recesses 26 so that the action of the return spring 13 carries the push button 11, and consequently the lever 21 and the shutter 20, back to the starting position.

As well as the above-mentioned advantage the embodiment of the regulator 2 according to the invention is simple and economical in that it does not require significant structural modifications with respect to known regulators.

Moreover, the regulator 2 according to the invention, as far as periods of inactivity of the regulator itself are concerned, can be managed by an inexpert user.

The regulator described above can have numerous modifications and variations introduced thereto by the man skilled in the art to satisfy particulars and contingent requirements, all however lying within the ambit of protection of the invention as defined in the following claims.

I claim:

1. A regulator for an underwater breathing apparatus comprising a body, a duct in the said body for delivering a breathable mixture, a shutter seat in the said duct, a shutter of soft material stressed by an adjustable spring towards the shutter seat, a push button acting via a lever on the shutter to control it to move away from the shutter seat upon manual delivery of breathable mixture, and including, in the said push button, removable locking means for locking the lever in a position in which the said lever retains the shutter in a position just touching the shutter seat, thereby preventing damage to the shutter by the shutter seat during periods of inactivity.

2. A regulator according to claim 1, wherein said removable locking means comprise a bayonet coupling for holding said push button in a push button seat.

3. A regulator according to claim 2, wherein said bayonet coupling comprises a plurality of hooks on the said push button and corresponding plurality of recesses in the said push button seat, which have respective engagement edges intended to interfere with the said hooks upon rotation of the push button in the push button seat.

4. A regulator according to claim 3, wherein it includes rapid resetting means for the lever in the push button, said rapid resetting means including a return spring biasing the said push button and a plurality of inclined shoulders in the said push button, positioned above the said hooks and disposed to interfere with the said engagement edges when the push button is pressed in fully starting from the said position in which the said lever retains the shutter in the position just touching the said shutter seat.

5. A regulator according to claim 1, wherein it includes rapid resetting means for the lever in the push button.

6. In a regulator for manual delivery of breathable mixture, said regulator comprising a body, a duct in the said body for delivering a breathable mixture, a shutter seat in the said duct, a shutter of soft material stressed by an adjustable spring towards the shutter seat, the improvement of a push button acting, via a lever, on the shutter to control it to move away from the shutter seat upon manual delivery of breathable mixture and including removable locking means for locking the lever in a position in which the said lever retains the shutter in a position just touching the shutter seat, thereby preventing damage to the shutter by the shutter seat during periods of inactivity.

7. A regulator according to claim 6, wherein said removable locking means comprise a bayonet coupling for holding said push button in a push button seat.

8. A regulator according to claim 7, wherein said bayonet coupling comprises a plurality of hooks on said push button and corresponding plurality of recesses in said push button seat, which have respective engagement edges intended to interfere with the said hooks upon rotation of the push button in the push button seat.

9. A regulator according to claim 6, wherein it includes rapid resetting means for the lever.

* * * * *

UNITED STATES PATENT AND TRADEMARK OFFICE

CERTIFICATE OF CORRECTION

PATENT NO. : 5,503,142

DATED : April 2, 1996

INVENTOR(S) : Roberto Semeia

It is certified that error appears in the above-identified patent and that said Letters Patent is hereby corrected as shown below:

On the Cover Page, [75] Inventor, change "San Salvatore di Cogorno, Italy" to --Genova, Italy--.

Signed and Sealed this

Twenty-fifth Day of June, 1996

*Attest:*

Bruce Lehman

BRUCE LEHMAN

*Attesting Officer*

*Commissioner of Patents and Trademarks*